United States Patent [19]

Brahm et al.

[11] 4,076,643

[45] Feb. 28, 1978

[54] PRE-MIXES INTENDED TO BE ADDED TO DETERGENT POWDERS BY POST-ADDITION

[75] Inventors: Jacques Brahm, Grimbergen; Julien Mulders, Dworp, both of Belgium

[73] Assignee: Solvay & Cie., Brussels, Belgium

[21] Appl. No.: 513,501

[22] Filed: Oct. 9, 1974

[30] Foreign Application Priority Data

Nov. 9, 1973 Belgium ..... 137587

[51] Int. Cl.[2] ..... C11D 3/37; C11D 3/20; C11D 11/00

[52] U.S. Cl. ..... 252/89 R; 252/DIG. 1; 252/DIG. 2; 252/DIG. 11

[58] Field of Search ..... 252/89, 180, DIG. 1, 252/DIG. 2, DIG. 11; 260/676 A

[56] References Cited

U.S. PATENT DOCUMENTS

| | | | |
|---|---|---|---|
| 3,227,688 | 1/1966 | Kern et al. | 260/676 |
| 3,306,858 | 2/1967 | Oberle | 252/99 |
| 3,519,570 | 7/1970 | McCarty | 252/DIG. 12 |
| 3,686,145 | 8/1972 | Haschke et al. | 260/676 |
| 3,691,107 | 9/1972 | Erdy et al. | 252/89 |
| 3,839,215 | 10/1974 | Mulders | 252/181 |
| 3,853,781 | 12/1974 | Haschke et al. | 252/89 R X |
| 3,915,878 | 10/1975 | Yurko et al. | 252/DIG. 1 X |
| 3,920,586 | 11/1975 | Bonaparte et al. | 252/DIG. 1 X |
| 3,956,380 | 5/1976 | Henning et al. | 252/89 R X |

*Primary Examiner*—Harris A. Pitlick
*Attorney, Agent, or Firm*—Spencer & Kaye

[57] ABSTRACT

The free flowing premixes which are intended to be added to detergent or washing powders, consists of particles which comprise, in the form of a water-soluble salt, a linear or branched hydroxycarboxylic polymer or copolymer, the main chain of which contains essentially carbon and carries carboxyl and hydroxyl groups in the respective proportion of 1:10 to 20:1, and one or more surface-active agents which are liquid or paste-like at a temperature below 180° C, in combination with the said polymer or copolymer.

13 Claims, No Drawings

PRE-MIXES INTENDED TO BE ADDED TO DETERGENT POWDERS BY POST-ADDITION

The present invention relates to free-flowing pre-mixes which are intended to be post-added to detergent or washing powders by spray-drying a suspension, as well as to the powders prepared in this way, and more particularly the invention relates to pre-mixes which are intended to be added to detergent powders which have a low or zero phosphorus and/or nitrogen content.

The surface-active agents which are most frequently used in detergent compositions in powder form are anionic compounds such as alkylarylsulphonates possessing higher alkyl groups and a single aromatic ring. These synthetic detergents, which are very effective for washing textiles, lose some of this efficacy in the presence of hard water. This is why they are used in conjuction with builders, also called detergency auxiliaries, one of the main functions of which is to soften the washing water.

The detergency auxiliaries which have been used to the greatest extent hitherto are sodium tripolyphosphate, sodium nitrilotriacetate and the like. Now, these compounds play a part in eutrophising the water in lakes and rivers because of the presence of phosphorus or nitrogen in their molecules.

This is the reason why numerous washing compositions with a restricted or zero phosphorus and nitrogen content have been sought and investigated.

In order to reduce the polyphosphate content of washing compositions, it has been proposed to replace the anionic surface-active agents at least partially by non-ionic surface-active agents.

As non-ionic surface active agents, there may be mentioned the products which owe their solubility in water to the presence of polyether chains, amine-oxide, sulphoxide or phosphine-oxide groups and alkylolamide groups, as well as, in general, to an accumulation of hydroxyl groups. The non-ionic surface-active agents which are most frequently used are alcohols with long carbon chains ethoxylated with ethylene oxide. They generally comprise an alkyl chain with 12 to 18 carbon atoms and an average of 10 to 19 ethylene oxide units.

Since non-ionic surface-active agents are less affected by the hardness of water than are anionic surface-active agents, it is thus possible to increase the proportion of non-ionic surface-active agents when the phosphate content is reduced.

The main disadvantage of this type of composition with a rather high content of non-ionic surface-active agents becomes apparent, however, during their manufacture. The non-ionic surface-active agents which possess a sufficiently high detergent power have an ethylene oxide content such that they are in general in the form of a viscous liquid or a paste at ambient temperature and consequently are not suitable for direct addition to the dry detergent powder. Furthermore, it has been established that if too large an amount, for example greater than 5% by weight, of non-ionic surface active agent is incorporated into the detergent suspension before spray-drying, a considerable problem relating to the capacity of the drier is encountered: since these surface-active agents decompose at the temperature usually employed in spray-driers, it is thus necessary to lower this temperature and consequently the capacity of the drier, otherwise dense black smoke escapes from the spray-drier tower, causing heavy pollution of the atmosphere.

For the purpose of avoiding these manufacturing disadvantages, Belgian Pat. No. 777,030 in the name of COLGATE-PALMOLIVE proposes free-flowing pre-mixes which are intended to be post-added to the detergent powder after it has been spray-dried. These pre-mixes comprise a vehicle, chosen from amongst the ingredients present in the detergent composition, to which the non-ionic surface-active agent is bound. Amongst the substances which can form the vehicle, there may be mentioned nitriloacetic acid and its salts, sodium carbonate, sodium citrate, nitrogen-containing organic compounds, particulate inorganic materials such as clays, diatomaceous earth and aluminum oxide, and organic compounds which do not contain nitrogen such as sodium glycollate, glycollic acid, sorbitol, sodium tartate or sodium perborate monohydrate.

In accordance with the present invention, it has now been discovered that it is possible further to improve the efficacy of detergent compositions containing a rather high proportion of non-ionic surface-active agent if use is made, in such pre-mixes, of a water-soluble salt of linear or branched hydroxycarboxylic polymers or copolymers, the main chain of which contains essentially carbon and the carboxyl and hydroxyl groups of which are in the respective proportion of 1:10 to 20:1, as a support (or vehicle) for the non-ionic surface-active agents. This also applies to other surface-active agents such as those which are heat-sensitive.

In this way, the problems posed by the incorporation of these surface-active agents by post-addition into a spray-dried powder and the omission (or reduction) of the phosphorus and nitrogen content of the detergent compositions are solved simultaneously, the compositions thus prepared retaining detergent properties which are comparable to those of the usual powders containing phosphate.

The present invention thus relates to a free-flowing pre-mix intended to be post-added to detergent or washing powders, characterised in that it consists of particles which comprise, in the form of a water-soluble salt, a linear or branched hydroxycarboxylic polymer or copolymer, the main chain of which contains essentially carbon and carries carboxyl and hydroxyl groups in the respective proportion of 1:10 to 20:1, and one or more surface-active agents which are liquid or paste-like at a temperature below 180° C, in combination with the said polymer or copolymer.

The —COOH/OH ratio of the hydroxycarboxylic polymer or copolymer will preferably be between 0.5 and 16, and will more particularly be equal to 1.

Amongst the hydroxycarboxylic polymers or copolymers which have proved to be good substitutes for sodium tripolyphosphate in detergent compositions, alkali metal or ammonium salts of poly-$\alpha$-hydroxyacrylic acids, as described in Belgian Pat. No. 776,705 in the name of Solvay & Cie., will preferably be chosen, since the latter possess the best builder properties. Amongst the other polymers or copolymers which can also be present in the pre-mixes of the invention, there may be mentioned, without implying a limitation, the copolymers described especially in Belgian Pat. No. 767,511 in the name of DEGUSSA, which comprise mainly $—CH_2—CR(COOA)—$, $—CH_2—CR(CR_2OH)—$ and/or $—CH_2—CHOH—$ monomer units as well as lower proportions of $—[CR(COOA)]_2—$, $—CH_2—C(CH_2OH)(COOA)—$ and/or $—CH_2—C(CH_2OH)_2—$ monomer units, these being copolymers for which the carboxyl/-hydroxyl ratio is between 1.1 and 16; likewise, vinyl alcohol/maleic acid (or anhydride) copolymers, as described in Belgian Pat. Nos. 757,034 and 795,450 in the names of KNAPSACK AG and ICI AMERICA respectively, may be mentioned. Any other polymers or copolymers with a similar structure are suitable for the pre-mixes according to the invention.

The amount of surface-active agent can be as much as approximately 12% by weight of the amount of polymer or copolymer, and is preferably greater than approximately 20% by weight of the latter.

Although any surface-active agents which are liquid or paste-like at temperatures below 180° C can be incorporated into the pre-mixes according to the present invention, preference will be given to non-ionic surface-active agents and anionic or amphoteric surface-active agents which are heat-sensitive.

Amongst the latter, non-ionic surface-active agents will be used more particularly. A single type of surface-active agent or mixtures of surface-active agents can be used in the composition which is the subject of the present invention. As mixtures of surface-active agents, mixtures of non-ionic surface-active agents with one another or mixtures of non-ionic surface-active agents with anionic or amphoteric surface-active agents should be mentioned more particularly.

As non-ionic surface-active agents, condensates of polyol ethers with long chain alcohols, fatty acids and alkylphenols which can contain 3 to 30 glycol ether groups and 8 to 20 carbon atoms in the alkyl chain, addition products of polyoxyethylene with polypropylene glycol, amine-oxides, oxysulphides and phosphine-oxides containing at least one $C_{10}$–$C_{20}$ radical and which may optionally be ethoxylated, and condensates of alkyl oxides with amines or amides will be used preferentially. Condensates of polyol ethers with long chain alcohols, fatty acids and alkylphenols, as defined above, are very particularly suitable.

Amongst the anionic surface-active agents which can be incorporated into the compositions, sulphonates and sulphates such as alkylarylsulphonates like dodecylbenzenesulphonate, alkylethylsulphonates, alkenylsulphonates, alkylsulphonates and alkyl sulphates, fatty α-sulpho-acid esters, alcohol sulphates or sulphates of ethoxylated amides and the like may be mentioned especially. Other suitable anionic surface-active agents are alkaline soaps of fatty acids of natural or synthetic origin. The anionic surface-active agents can be in the form of sodium, potassium or ammonium salts, or in the form of salts of organic bases such as monoethanolamine, diethanolamine or triethanolamine.

The ampholytic and amphoteric surface-active agents which can be used will be especially derivatives such as 3-(N,N-dimethyl-N-hexadecyl-amino)-propane-1-sulphonate or 3-(N,N-dimethyl-N-hexadecyl-ammonio-2-hydroxy-propane-1-sulphonate) (sic), alkylsulphobetaines, amidoalkenesulphonates, aliphatic amines substituted by a carboxy-, sulpho-, phosphato- or phosphino-group and the like.

This list of surface-active agents is given by way of example; it is obvious that surface-active agents other than those referred to above can also be suitable, such as those mentioned in the book "Surface Active Agents" by A. M. Schwarz and J. W. Perry of in U.S. Pat. No. 3,159,581.

The pre-mixes which are the subject of the present invention possess the advantage that the polymers or copolymers used as vehicles for the surface-active agent(s) are substances which possess builder properties.

The pre-mixes according to the invention can be prepared in accordance with any technique which is in itself known. However, care must be taken firstly that the particle size of these pre-mixes is such that no segregation is apparent in the final product when it is stored and transported, in order that the powder shall remain very homogeneous and, secondly, that their flow properties and their mechanical properties are compatible with those of the detergent powders. The particle size chosen will depend on the particle size of the other components of the detergent powder. In general, a particle size such that 80% of the particles have a diameter of between 0.15 and 1.5 mm is suitable for most detergent compositions.

The following techniques may be mentioned, without implying a limitation, amongst the techniques which lead to pre-mixes according to the invention which have suitable properties.

A first technique consists of adding the liquid or paste-like surface-active agent to the hydroxycarboxylic polymer used as a support, in the form of a fine powder, as well as optionally a certain amount (usually 0.1 to 30% of the total weight) of water or some other binder. This operation can be carried out at a temperature of between 15° and 80° C. Thereafter, the mixture obtained is granulated and dried by any suitable method.

A second technique consists of preparing granules of hydroxycarboxylic polymer which can be pure or can contain a small proportion of water or some other binder which can moreover already be a surface-active agent, and then of incorporating the liquid or paste-like surface-active agent into these granules.

The surface-active agent can be incorporated in any way which is in itself known, and especially by simple mixing; the surface-active agent can optionally be preheated to temperatures of between 20° and 180° C, and preferaby 30 ° to 150° C, in order to make it more fluid.

These polymer granules can be prepared by any method which is in itself known and which is suitable for this type of compound. For example, the polymer can be compacted and then broken up and screened, or it can be granulated, especially in a granule press or in a mixer, and then broken up and screened. These granulation processes can be carried out in the presence of a binder such as water or even a surface-active agent.

These processes are mainly applicable to suface-active agents which are liquid or paste-like at temperatures below 180° C. Above this temperature, the risk of degradation of the hydroxycarboxylic polymers in fact arises.

The particles of the premixes thus obtained can then be coated, for example in order to increase their mechanical strength. The process can be carried out especially in a fluidised bed, and silicates can be used as the coating material.

The following examples illustrate methods for preparing pre-mixes according to the present invention, without in any way limiting the scope thereof. The liquid non-ionic surface-active agent used for these examples is "DOBANOL 45-11" (Trademark registered by Shell) consisting of an ethoxylated $C_{14}$–$C_{15}$ cut containing 11 molecules of ethylene oxide, and the hydroxycarboxylic polymer is sodium poly-α-hydroxyacrylate.

EXAMPLE 1

Sodium poly-α-hydroxyacrylate, pre-heated to 40° C, is mixed with the liquid non-ionic surface-active agent also pre-heated to 40° C and, optionally, water, in a HOBART planetary-type mixer. The mixture obtained is then granulated in an ALEXANDERWERK GA 65 granulation press comprising a smooth cylinder and a perforated cylinder. The granules obtained, which have a diameter of 1 or 2 mm depending on the size of the holes of the granulator, are screened to 500μ so as to remove the fine particles which are recycled, and then the granules are dried at 70°-100° C in a ventilated oven. After cooling, it is optionally possible to break up and then grade the granules in order to obtain the desired particle size.

Free-flowing pre-mixes according to the invention, which can contain 34% of surface-active agent relative to the weight of sodium poly-α-hydroxyacrylate, are obtained by this method. A larger amount of surface-active agent can be fixed, but then the physical properties of the pre-mix are less good.

EXAMPLE 2

Dry sodium poly-α-hydroxyacrylate is compacted in a pellet-making machine. Pellets of diameter 12.4 mm and thickness 3 mm are thus prepared. These pellets are then broken up and screened in order to obtain the desired particle size.

Thereafter, up to 34% of surface-active agent relative to the weight of sodium poly-α-hydroxyacrylate can be incorporated by simple mixing.

The pre-mixes thus obtained prossess very good physical properties and very free-flowing.

The amounts of non-ionic surface-active agent fixed to the sodium poly-α-hydroxyacrylate in the above two examples are not limiting. These amounts can in fact vary as a function of the nature of the hydroxycarboxylic polymer and the surface-active agent, the technique for preparing the pre-mix and the mechanical characteristics desired for this pre-mix. The amount of surface-active agent present can also be increased if the granules of pre-mix are suitably coated.

The efficacy of the washing powders free from phosphorus and nitrogen, or containing a small amount of these two elements, prepared by a post-addition of the pre-mixes according to the invention to spray-dried powders, is comparable to those containing phosphates, since sodium poly-α-hydroxyacrylate possesses builder properties comparable to those of polyphosphates, as has been shown in Belgian Pat. No. 776,705 in the name of Solvay & Cie. Moreover, they possess the advantage of not contributing to the eutrophisation of water.

The pre-mixes of the invention thus make it possible to solve both the problem of incorporating liquid or paste-like or heat-sensitive surface-active agents into washing powders and the omission (or reduction) of phosphorus and nitrogen, whilst not sacrificing the detergent properties of these powders.

We claim:

1. In a free-flowing pre-mix intended to be post-added to detergent or washing powders, the improvement wherein the pre-mix consists of particles which consist essentially of, in the form of a water-soluble salt, a linear or branched hydroxycarboxylic polymer or copolymer, the main chain of which contains essentially carbon and carries carboxyl and hydroxyl groups in the respective proportion of 1:10 and 20:1, and one or more surface-active agents which are liquid or paste-like at a temperature below 180° C, and supported by said polymer or copolymer, the amount of said surface-active agent being from about 20% to 120% by weight of the amount of said polymer or copolymer.

2. Pre-mix according to claim 1, wherein the ratio of carboxyl to hydroxyl groups of the polymer or copolymer is between 1:2 and 16:1.

3. Pre-mix according to claim 1, wherein the ratio of carboxyl to hydroxyl groups of the polymer or copolymer is equal to 1.

4. Pre-mix according to claim 1, wherein the hydroxycarboxylic polymer is a water-soluble salt of poly-α-hydroxyacrylic acid.

5. Pre-mix according to claim 1, wherein the surface-active agent is a non-ionic surface-active agent or an anionic or amphoteric surface-active agent which is heat-sensitive.

6. Pre-mix according to claim 1, wherein the pre-mix is in the form of granules.

7. Pre-mix according to claim 1, wherein the hydroxycarboxylic polymer is a water-soluble sodium salt of poly-α-hydroxyacrylic acid.

8. In a free-flowing solid pre-mix intended to be post-added to detergent or washing powders, consisting of solid particles and one or more surface-active agents which are liquid or paste-like at a temperature below 180° C and supported by said solid particles, the improvement wherein the solid particles consist of particles, in the form of a water-soluble salt, of a linear or branched hydroxycarboxylic polymer or copolymer, the main chain of which contains essentially carbon and carries carboxyl and hydroxyl groups in the respective proportion of 1:10 to 20:1, the amount of said surface-active agent being from about 20% to 120% by weight of the amount of said polymer or copolymer.

9. Detergent or washing powders prepared by the post-addition of a pre-mix according to claim 1 to a detergent powder prepared by spray-drying.

10. Process for the manufacture of a free-flowing pre-mix of particles intended to be post-added to detergent or washing powders, consisting essentially of mixing a water-soluble salt of a linear or branched hydroxycarboxylic polymer or copolymer, the main chain of which contains essentially carbon and carries carboxyl and hydroxyl groups in the respective proportions of 1:10 to 20:1, with one or more surface-active agents which are liquid or paste-like at a temperature below 180° C to form a mixture, and then granulating the mixture.

11. The process according to claim 10, wherein during said mixing, 0.1 to 30% of the total weight of a binder is mixed with the surface-active agent and said polymer or copolymer.

12. The process according to claim 10, wherein the binder comprises water.

13. Process for the manufacture of a free-flowing premix of particles intended to be post-added to detergent or washing powders, consisting essentially of mixing granules of a water-soluble salt of a linear or branched hydroxycarboxylic polymer or copolymer, the main chain of which contains essentially carbon and carries carboxyl and hydroxyl groups in the respective proportion of 1:10 and 20:1, with one or more surface-active agents which are liquid or paste-like at a temperature below 180° C.

* * * * *